United States Patent [19]

Osuga et al.

[11] Patent Number: 4,748,953

[45] Date of Patent: Jun. 7, 1988

[54] AIR/FUEL RATIO CONTROL APPARATUS FOR INTERNAL COMBUSTION ENGINES

[75] Inventors: Minoru Osuga; Yoshishige Oyama, both of Katsuta, Japan

[73] Assignee: Hitachi, Ltd., Tokyo, Japan

[21] Appl. No.: 932,375

[22] Filed: Nov. 20, 1986

[30] Foreign Application Priority Data

Nov. 20, 1985 [JP] Japan ..... 60-258555

[51] Int. Cl.[4] ..... F02M 7/00

[52] U.S. Cl. ..... 123/440; 123/489

[58] Field of Search ..... 123/489, 440, 494

[56] References Cited

U.S. PATENT DOCUMENTS 4,169,440 10/1979 Taplin ..... 123/489
4,461,258 7/1984 Becker ..... 123/489
4,475,517 10/1984 Kobayashi ..... 123/489

*Primary Examiner*—Ronald B. Cox
*Attorney, Agent, or Firm*—Antonelli, Terry & Wands

[57] ABSTRACT

In feedback control for the air/fuel ratio based on a sensor producing an output signal proportional to a change in the air/fuel ratio, a control constant modifier is operative to vary the proportional component and the integration component in a feedback system in accordance with an air/fuel ratio set for controlling, thereby assuring stability of ultimate fuel control.

6 Claims, 15 Drawing Sheets

AIR/FUEL RATIO CONTROL APPARATUS FOR INTERNAL COMBUSTION ENGINES

BACKGROUND OF THE INVENTION

This invention relates to an air/fuel ratio control apparatus for internal combustion engines.

Conventionally, an air/fuel ratio control apparatus uses a conventional oxygen sensor, the output signal of which changes stepwise between upper and lower levels at an air/fuel ratio λ equal to one (stoichiometric air/fuel ratio), as described in JP-A-51-106828. Accordingly, if the conventional air/fuel ratio control apparatus is employed with another type of air/fuel ratio sensor whose output changes in proportion to the air/fuel ratio, the control system will operate erroneously. More particularly, in the sensor producing an output signal proportional to the air/fuel ratio, the gain relative to the air/fuel ratio is smaller in the lean region and larger in the rich region. Therefore, if the proportional constant of the control system, for example, remains unchanged throughout the rich and lean regions, an erroneous operation, such as hunting, will result within either one of the rich and lean regions.

SUMMARY OF THE INVENTION

An object of this invention is to provide an air/fuel ratio control apparatus which can use a sensor of the type which provides an output signal proportional to the air/fuel ratio without causing hunting and the like.

This invention features that, with use of a sensor producing a proportional detection signal, the propotional or integration constant of a proportional or integration circuit of the air/fuel ratio control system is changed in compliance with a set control value of air/fuel ratio.

DESCRIPTION OF THE PREFERRED EMBODIMENTS

Figure 1:
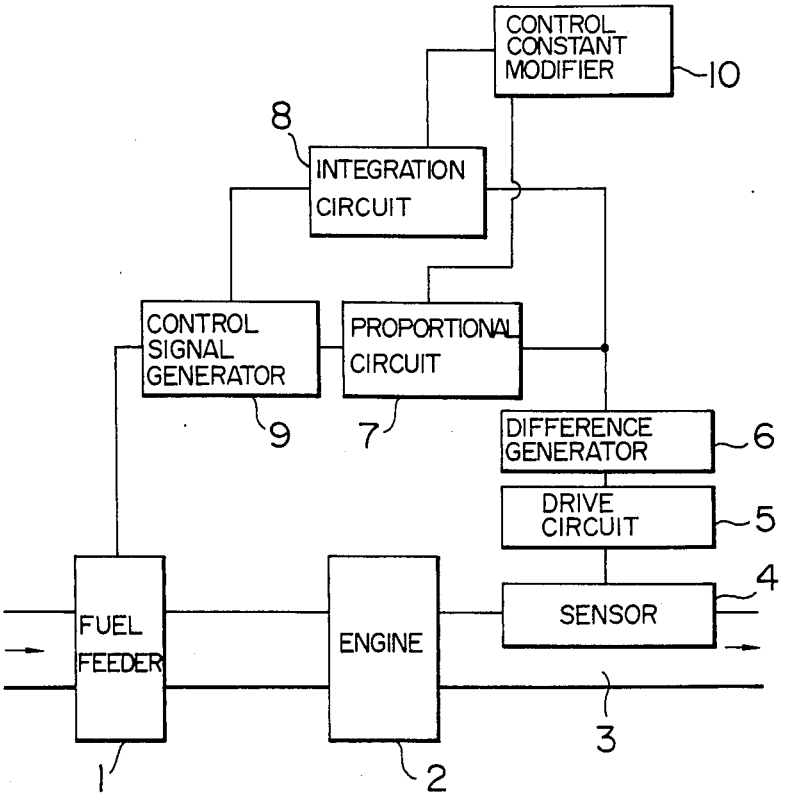
FIG. 1 is a schematic block diagram showing the overall construction of an air/fuel ratio control apparatus according to an embodiment of the invention.

Referring now to FIG. 1, there is illustrated, in block form, an air/fuel ratio control apparatus embodying the invention. The apparatus comprises a fuel feeder 1 for feeding fuel to an engine 2, and an air/fuel ratio sensor 4 mounted in an exhaust pipe 3. A drive circuit 5 for the sensor 4 transmits a signal proportional to an air/fuel ratio. Based on this signal, a difference generator 6 determines a difference between a set value and a detected value, and the difference is applied to a proportional circuit 7 and an integration circuit 8. A control signal generator 9 is responsive to output signals from the proportional circuit 7 and integration circuit 8 to generate and output a control signal to the fuel feeder 1 such as an electronic fuel injection valve. Thus, the control apparatus of the above construction is well adapted to implement proportional and integration closed loop control of the air/fuel ratio. This apparatus may otherwise be used with a differentiation control system to perform PID control.

Figure 2:
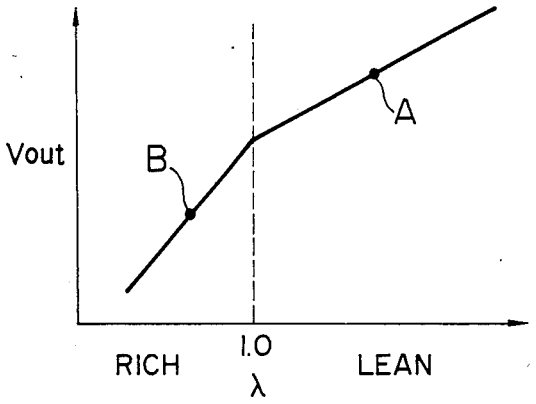
FIG. 2 is a graph showing a sensor output characteristic.

Since, as shown in FIG. 2, the air/fuel ratio sensor 4 has different output gains relative to air/fuel ratio λ for a lean region where $\lambda > 1.0$ and for a rich region where $\lambda < 1.0$, the proportional constant of proportional circuit 7 and the integration constant of integration circuit 8 for closed loop control at a point A within the lean region must be changed from those for closed control at a point B within the rich region. Especially, the proportional control system is predominant in the closed loop control and so stability of the closed loop control system is greatly affected by changes in the proportional constant. Therefore, the apparatus of FIG. 1 further comprises a control constant modifier 10 adapted to issue commands which change the control constant of the proportional circuit 7 mainly and also the control constant of the integration circuit 8 in compliance with a set control value of air/fuel ratio.

Components of the apparatus shown in FIG. 1 will now be described in greater detail.

Figure 3:
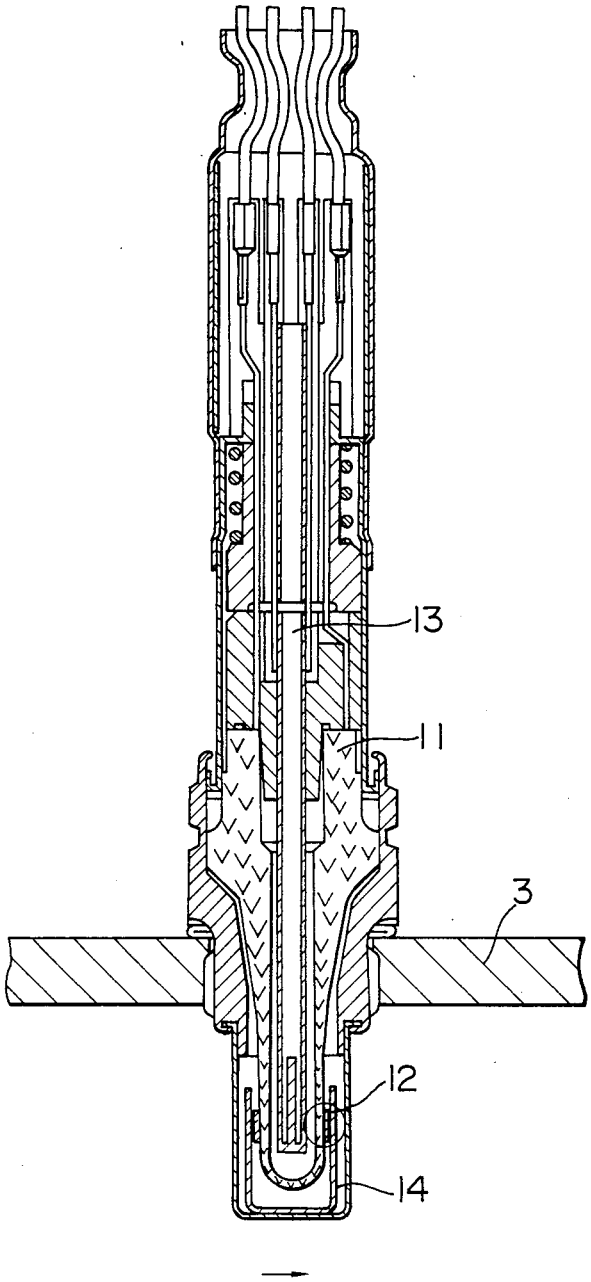
FIG. 3 is a sectional view showing the construction of an air/fuel ratio sensor.

The air/fuel ratio sensor 4 is constructed as shown in FIG. 3, having a solid electrolyte 11, a diffusion resistor 12 of a porous material, a heater 13 for heating the solid electrolyte 11, and a protective tube 14. When the solid electrolyte 11 having ability to conduct oxygen ions is heated to about 600° to 1000° C. by means of the heater 13 and current or voltage is supplied to electrodes provided, as will be described later, on the opposite side surfaces of solid electrolyte 11, an amount of oxygen, which is proportional to amounts of electricity supplied to the opposite side surfaces, propagates through the solid electrolyte 11. The amount of oxygen prevailing in the diffusion resistor 12 is then controlled by utilizing this oxygen pumping effect such that the partial pressure of oxygen inside the diffusion resistor 12 is always constant. Then, the amounts of electricity consumed to establish the constant oxygen partial pressure are in proportion to an air/fuel ratio. In the solid electrolyte 11, atmospheric air is admitted to the interior side surface and an exhaust gas is admitted to the exterior side surface.

Figure 4A:
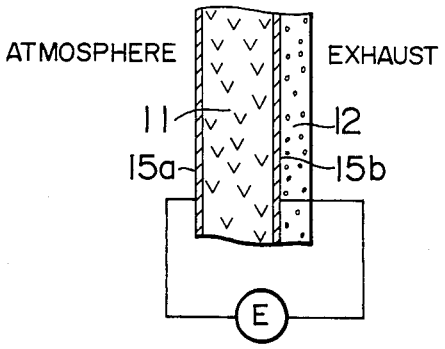
FIGS. 4A, 4B, 5, 6, and 7 are illustrative of the principle of one type of air/fuel ratio sensor.
Figure 4B:
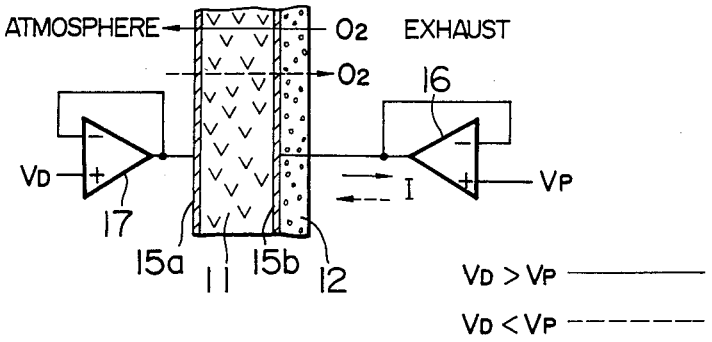
Figure 5:
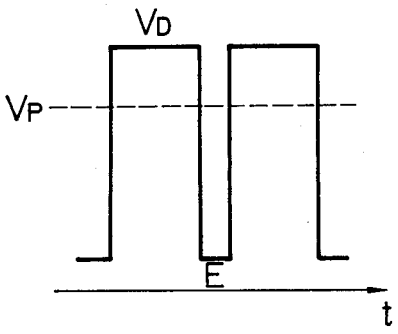
Figure 6:
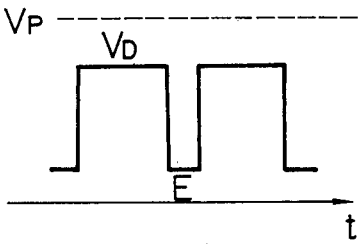

FIG. 4 is illustrative of the principle of air/fuel ratio detection. In particular, an encircled portion in FIG. 3 is enlarged for illustration at (a) in FIG. 4. An electrode 15*a* is provided on a side surface exposed to atmosphere and an electrode 15*b* is provided on the opposite side surface exposed to the exhaust gas. As is seen at (a) in FIG. 4, an electromotive force E developing in the solid electrolyte 11 is measured. By measuring this E, the oxygen partial pressure inside the diffusion resistor 12 can be measured. More specifically, when an amount of oxygen is charged into or discharged from the interior of the diffusion resistor 12 so as to keep constant the E representative of the oxygen partial pressure, this amount of propagating oxygen is determined by amounts of electricity supplied to the opposite side surfaces, which amounts are in turn proportional to an air/fuel ratio under measurement and set for controlling. The amount of oxygen inside the diffusion resistor 12 is controlled as shown at section (b) in FIG. 4. The electrode 15*b* is applied with a fixed voltage $V_P$ through a buffer amplifier 16 and the electrode 15*a* is applied with a voltage $V_D$ through a buffer amplifier 17. When $V_D > V_P$ is established by changing the voltage $V_D$, a current I is passed in a direction of solid arrow and the oxygen $O_2$ in the diffusion resistor 12 is consequently discharged in a direction of solid arrow. As a result, the amount of oxygen inside the diffusion resistor 12 is decreased. When the voltage $V_D$ is decreased to establish $V_D < V_P$, a current I is passed in a direction of dotted arrow and the oxygen $O_2$ is charged in a direction of dotted arrow, thus increasing the amount of oxygen inside the diffusion resistor 12. In this way, the electromotive force E representative of the partial pressure of oxygen within the diffusion resistor 12 can be controlled so as to be always constant. The measurement of E and the application of the voltage $V_D$ are alternately effected on a time division basis. The alternate operations are accomplished for the lean region as illustrated in the timing chart of FIG. 5 wherein $V_D > V_P$ is established during a period for the application of $V_D$ to obtain the constant electromotive force E. For the rich region, $V_D < V_P$ is established to obtain the constant electromotive force E as illustrated in the timing chart of FIG. 6. In FIGS. 5 and 6, the level of $V_D$ settled for the constant E is in proportion to a set control value of air/fuel ratio.

Figure 7:
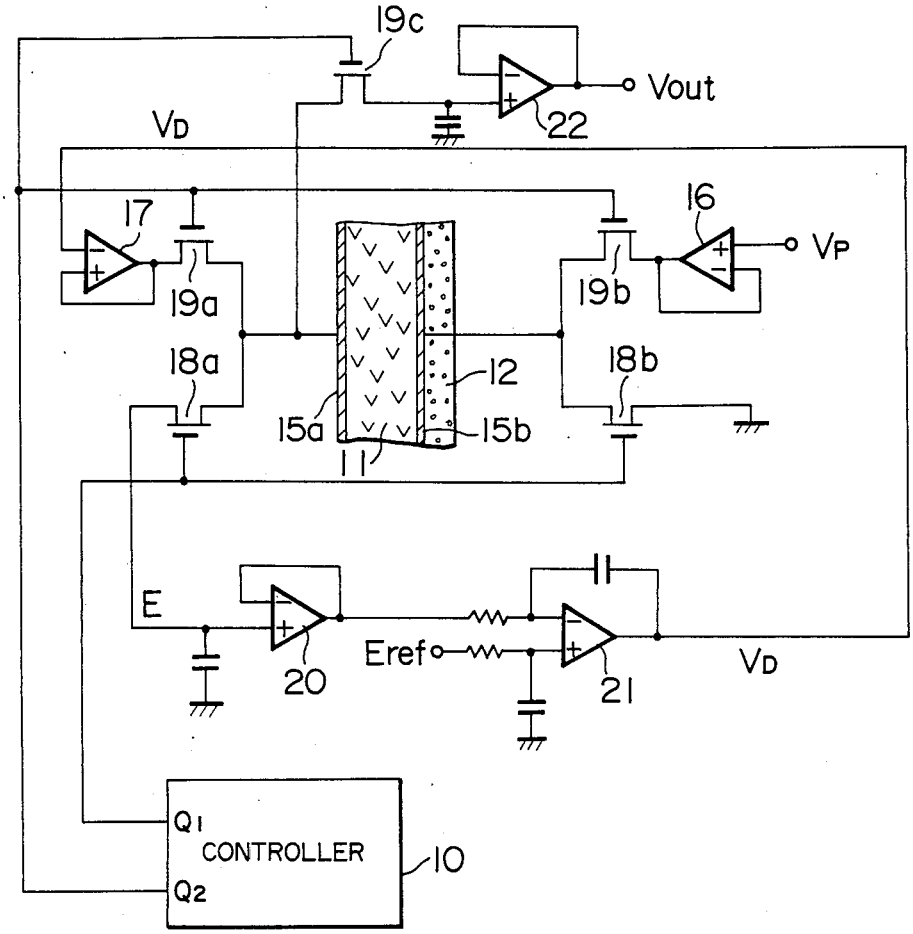
Figure 8:
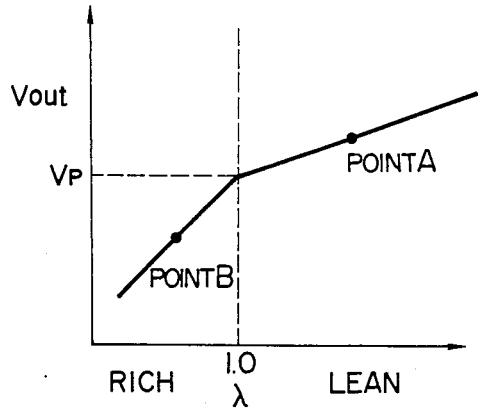
FIG. 8 is a graph showing a characteristic of the sensor of FIGS. 4 to 7.

The aforementioned alternate operations are carried out with a specified circuit arrangement as shown in FIG. 7. Initially, an electromotive force E is measured by opening switches 19*a* and 19*b* and closing switches 18*a* and 18*b* under the direction of a controller 80, so that E is held by a circuit comprised of an amplifier 20. Subsequently, a differential integration circuit comprised of an amplifier 21 compares the measured E with a reference voltage $E_{ref}$ (constant) and then integrates the difference between the E and $E_{ref}$ to increase or decrease the voltage $V_D$ in accordance with a time constant. Specifically, for $E > E_{ref}$, the voltage $V_D$ is decreased and for $E < E_{ref}$, increased. Thereafter, the thus varied voltage $V_D$ is applied to the solid electrolyte 11 by opening the switches 18*a* and 18*b* and closing the switches 19*a* and 19*b*. With the circuit arrangement constructed as above, even when the air/fuel ratio changes, the voltage $V_D$ is controlled for increase or decrease to always make the value of E equal to $E_{ref}$ and hence it is placed in proportion to an air/fuel ratio under measurement. By closing switch 19*c* simultaneously with the closing of switches 19*a* and 19*b*, the voltage $V_D$ is held by a hold circuit comprised of an amplifier 22 and is delivered as an output signal $V_{out}$. The output signal $V_{out}$ is related to the air/fuel ratio λ as graphically illustrated in FIG. 8. At $\lambda = 1.0$ (stoichiometric air/fuel ratio), the value of $V_{out}$ equals $V_P$ which is time-invariable. The value of $V_{out}$ is subject to gains which are different for the rich and lean regions. In particular, the sensor is more sensitive in the rich region and less sensitive in the lean region.

Figure 9:
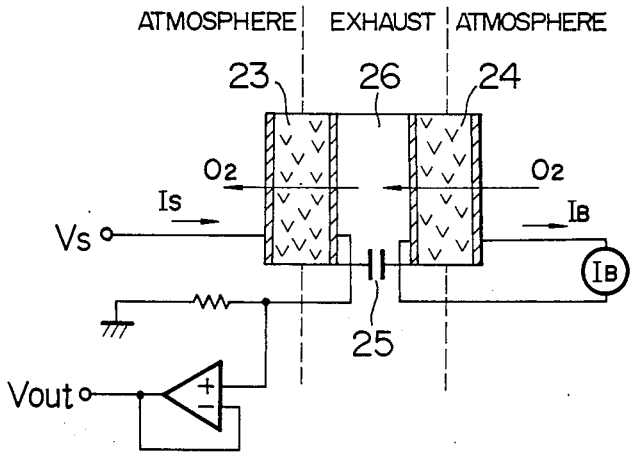
FIG. 9 is illustrative of the principle of another type of sensor.

In addition to the above method, various methods have been proposed for measurement of the air/fuel ratio over a wide range covering the rich and lean regions, including one that is executed with an arrangement as shown in FIG. 9.

The arrangement of FIG. 9 includes solid electrolytes 23 and 24, a diffusion hole 25 and a chamber 26. When a fixed current $I_B$ is supplied to the solid electrolyte 24 in a direction of the arrow, oxygen $O_2$ in the atmosphere is charged into the chamber 26. When the other solid electrolyte 23 is applied with a fixed voltage $V_S$ of 0.2 to 1.0 V, the diffusion hole 25 functions to generate a so-called marginal current $I_S$ which is proportional to an amount of oxygen inside the chamber 26. In the lean region, $I_S$ takes a value which is proportional to the sum of an amount of oxygen charged by $I_B$ and an amount of oxygen contained in exhaust gas diffusing into the chamber through the diffusion hole 25. In the rich region, the oxygen charged by $I_B$ is consumed by a combustible gas of CO, HC and $H_2$ diffusing into the chamber 26 and $I_S$ takes a value which is proportional to an amount of the remaining oxygen. As the air/fuel ratio λ falls below 1.0 with the content of the combustible gas increased, the value of $I_S$ decreases.

Figure 10:
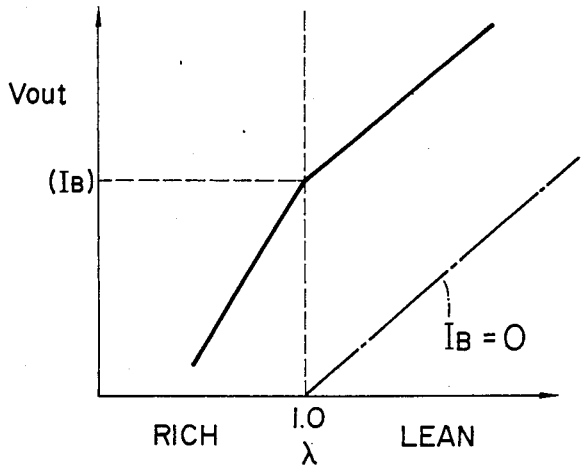
FIG. 10 graphically illustrates a characteristic of the FIG. 9 sensor.

Thus, the output signal $V_{out}$ corresponding to $I_S$ is related to the air/fuel ratio λ as graphically illustrated in FIG. 10. For $I_{B=0}$, $I_S$ can be measured only within the lean region, as indicated by a curve (a). Where $I_B$ is a positive fixed value, a characteristic curve (b) is obtained, indicating that the measurement of the air/fuel ratio can be permitted over a wide range. In this method, the value of $V_{out}$ is subject to gains relative to λ which are different for the rich and lean regions.

Figure 11:
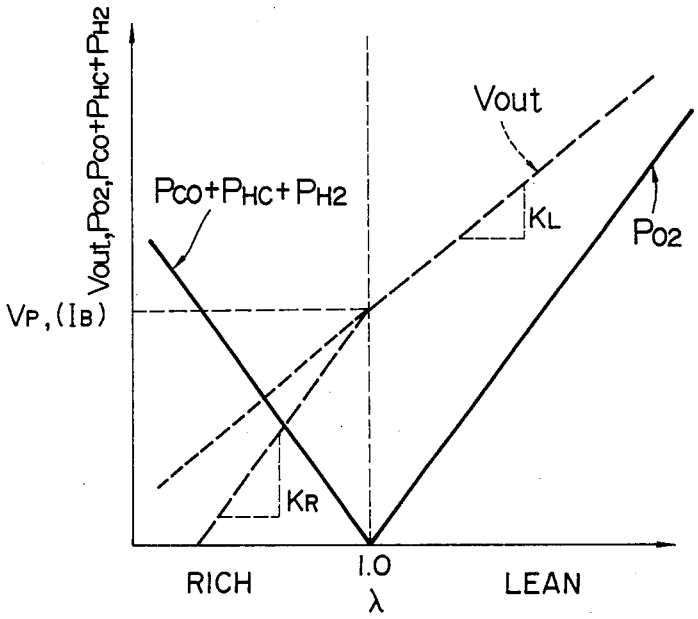
FIG. 11 is a graph showing various characteristics of the sensor.

Characteristics of the air/fuel ratio sensor will be described in more detail with reference to FIG. 11.

In the lean region, the oxygen partial pressure, $P_{O2}$, increases as the air/fuel ratio λ increases, causing the $V_{out}$ to increase. In the rich region, the partial pressure of CO, HC and $H_2$ combustible gas, $P_{CO}+P_{HC}+P_{H2}$, increases as the λ decreases, causing the $V_{out}$ to decrease. Especially, in the rich region where $\lambda < 1.0$, the gain is different from that for the lean region to deviate from a dotted-line extension (a) because a constituent $H_2$ gas has 3 to 4 times the diffusion speed of the remaining gas $O_2$, CO or HC and consumes a great amount of oxygen charged into the diffusion resistor through the solid electrolyte. Therefore, the gain $K_R$ for the rich region becomes larger than the gain $K_L$ for the lean region.

This invention contemplates improvements in air/fuel ratio control based on the sensor having sensitivity which, as has been explained hereinbefore, is different for the rich and lean regions.

Figure 12:
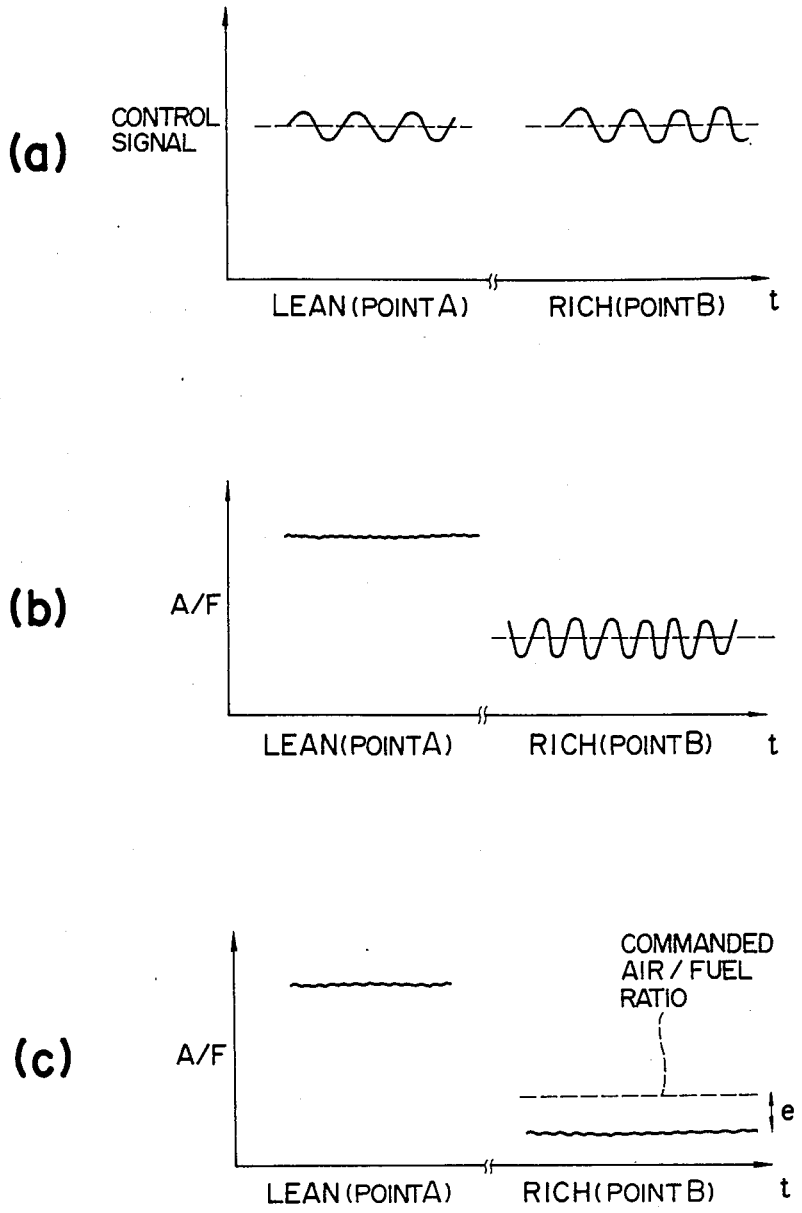
FIGS. 12(*a*), 12(*b*), 12(*c*), 13, 14(*a*) and 14(*b*) are graphs showing closed loop control of the air/fuel ratio and closed loop control characteristics.

When using such a sensor, the air/fuel ratio can be controlled through proportional and integration closed loop control as will be described with reference to FIGS. 12, 13 and 14. FIG. 12 illustrates at section (a) a control signal for controlling the amount of fuel. Since combustion conditions in the engine slightly vary even under normal operation, the control signal also varies slightly as indicated at (a) in FIG. 12 to correct a variation in combustion. FIG. 12 also indicates at (a) that values of the proportional and integration constants remain unchanged throughout the lean and rich regions. In such a case, owing to the different gains devoted to $V_{out}$, an erroneous operation takes place in either one of the lean and rich regions. For example, if the control constants are set to meet the conditions of the lean region, then controlling with the same control constants will lead to too high a proportional gain in the rich region and hunting will result as shown at (b) in FIG. 12. Even without the occurrence of hunting, the ultimate air/fuel ratio will deviate from a commanded air/fuel ratio by a stationary difference e in the rich region as indicated at (c) in FIG. 12. To solve the above problems, it is necessary to change the control constants such that they meet the conditions of both the rich and lean regions.

Figure 13:
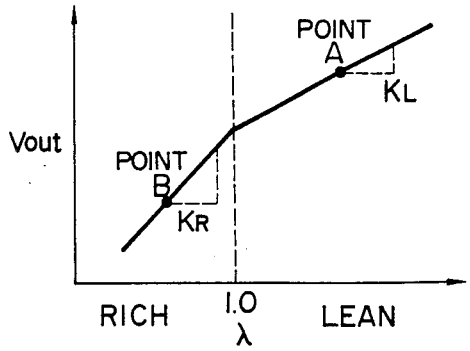
Figure 14:
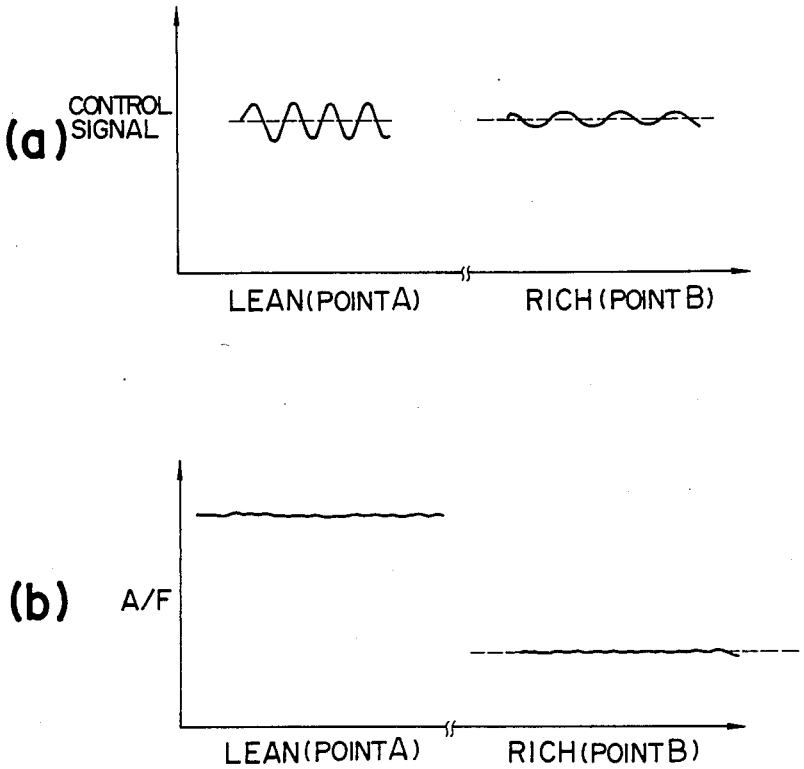

To this end, according to this invention, the proportional gain is varied complementarily to the different gains $K_R$ and $K_L$ shown in FIG. 13, that is, made smaller for the rich region than for the lean region as shown at (a) in FIG. 14. By using the varying proportional gain, the ultimate air/fuel ratio freed from hunting or stationary difference e can be obtained even in the rich region as shown at (b) in FIG. 14. Especially where the varying proportional gain requires the integration time constant to vary, the integration constant needs to be varied for the rich and lean regions.

Figure 15:
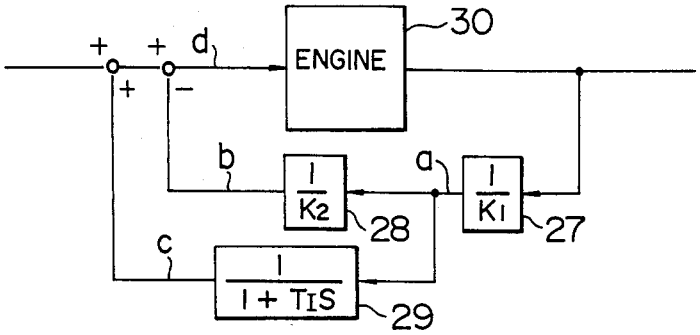
FIG. 15 is a block diagram of an air/fuel ratio closed loop control system.

The proportional and integration control system is generally and schematically illustrated for clarity of explanation in a block diagram of FIG. 15. Referring to FIG. 15, an engine 30 illustrated as a block includes a fuel feed system and is controlled in terms of air/fuel ratio. A circuit 27 for deriving and producing a difference a has a proportional gain of $K_1$. This difference is multiplied by a constant gain $K_2$ at a block 28 to prepare a proportional component b of the control signal. The difference a is also integrated at a block 29 to prepare an integration component c of the control signal. The integration component is added to the input signal to remove an offset.

Figure 16:
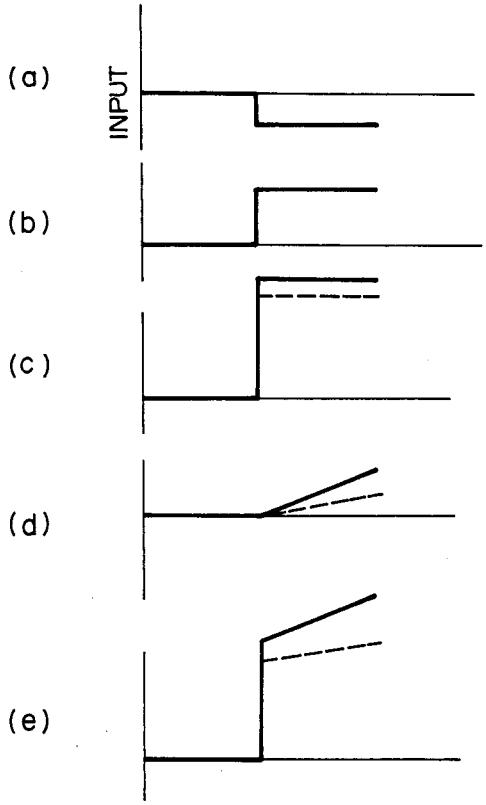
FIG. 16 is a diagram showing signal waveforms appearing in the system of FIG. 15.

When the input signal is applied stepwise as indicated at (a) in FIG. 16, this signal is processed into a difference which in turn is multiplied by the gain $K_1$ to provide the difference signal a as indicated at (b) in FIG. 16. The difference signal a is further multiplied by the gain $K_2$ to provide the signal b as indicated at (c) in FIG. 16. The difference signal a is also integrated with a time constant $T_I$ to provide the signal c as indicated at (d) in FIG. 16. The proportional signal b and the integration signal c are added together to provide a signal d as indicated at (e) in FIG. 16. If the proportional gain $K_2$ of block 28 is decreased, the signal b is decreased as indicated by a dotted line at (c) in FIG. 16 and on the other hand, if the integration time constant $T_I$ of block 29 is increased, the signal c is decreased as indicated by a dotted line at (d) in FIG. 16 with the result that the sum signal d is also decreased as indicated by a dotted line at (e) in FIG. 16.

In this manner, various results can be obtained by changing the proportional and integration constants, more specifically, by changing the proportional gain $K_2$ and integration time constant $T_I$. Thus, in accordance with the present invention, the two values for the rich region are made different from those for the lean region.

Figure 17:
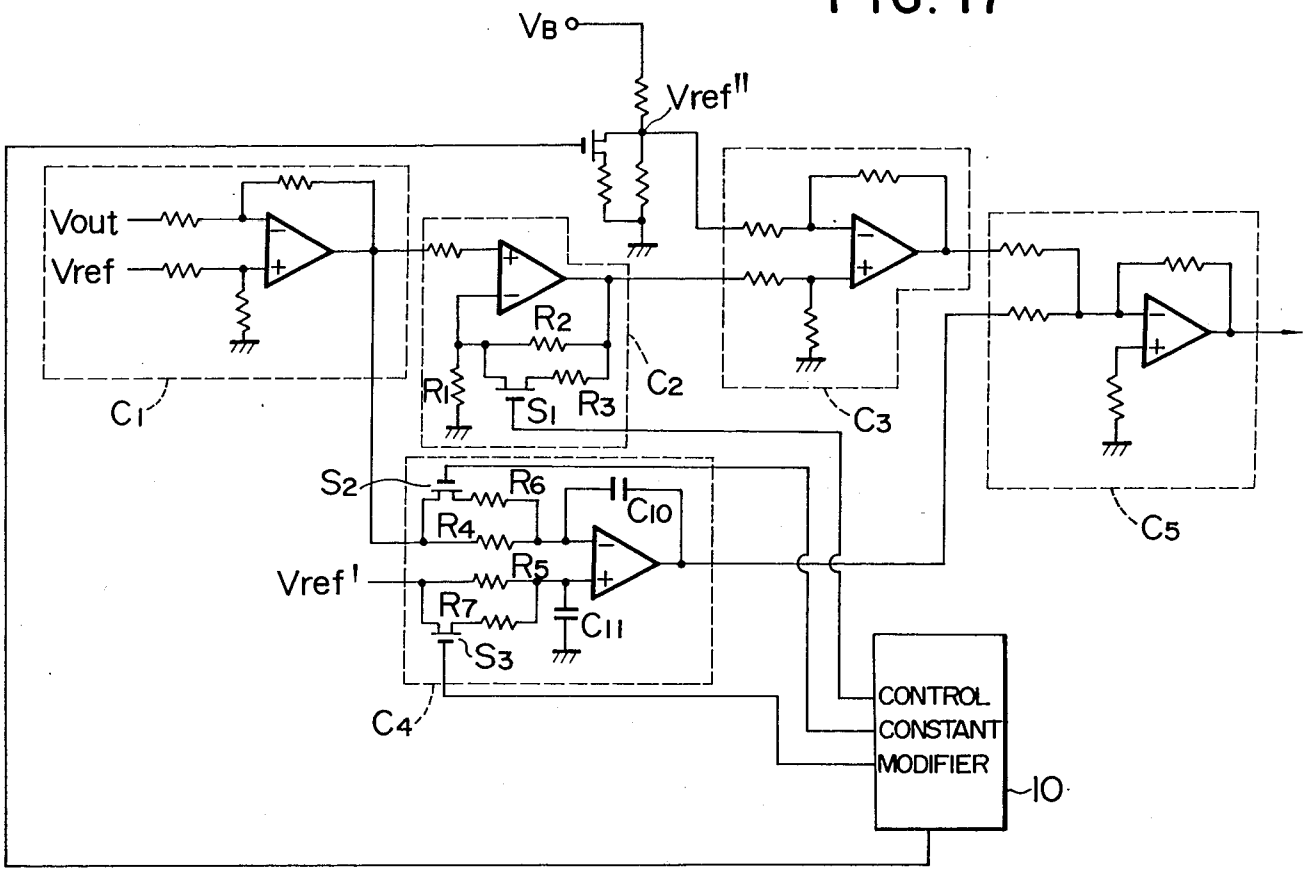
FIG. 17 is a circuit diagram for implementation of the FIG. 15 system according to an embodiment of the invention.

FIG. 17 illustrates, in block form, an embodiment of a circuit for implementation of the FIG. 15 control system.

Referring to FIG. 17, a difference circuit $C_1$ produces a difference between the output signal $V_{out}$ and a voltage $V_{ref}$ which is the sum of a commanded value and a fixed value. The output signal of the difference circuit $C_1$ is multiplied by the proportional gain $K_2$ at an amplifier circuit $C_2$. This amplifier circuit $C_2$ produces an amplified signal which contains an amplified AC component and an amplified DC component and so, the amplified DC component ($V_{ref}''$) is subtracted at a subtraction circuit $C_3$ to provide a difference signal representative of deviation from the commanded value and which is multiplied by the proportional gain $K_2$.

The output signal of the difference circuit $C_1$ is also supplied to a differential integration circuit $C_4$ so as to be compared with a voltage $V_{ref}'$ corresponding to the commanded value, so that an integrated signal in accordance with a difference representative of deviation from the commanded value is delivered out of the differential integration circuit $C_4$. The integrated signal is increasing when the output signal of the difference circuit $C_1$ is larger than the $V_{ref}'$ and is decreasing when the output signal is smaller than the $V_{ref}'$, indicating that correct integration operations are being carried out.

The thus obtained proportional component and integration component are added together at an adder circuit $C_5$ to provide a control signal.

In the circuit of FIG. 17, the proportional constant and the integration constant can be varied as will be described below. Since the proportional constant is defined by a resistance ratio between resistances of resistors $R_1$ and $R_2$ included in the amplifier circuit $C_2$, the proportional constant can be varied by turning on or off a switch $S_1$ to connect or disconnect a resistor $R_3$ in parallel relationship with the resistor $R_2$. The switch $S_1$ is operated by a command from the control constant modifier 10. Similarly, the integration constant, defined by resistances of resistors $R_4$ and $R_5$ and capacitances of capacitors $C_{10}$ and $C_{11}$ of the integration circuit $C_4$, can be varied by turning on or off a switch $S_2$ to connect or disconnect a resistor $R_6$ in parallel relationship with the resistor $R_4$ and by turning on or off a switch $S_3$ to connect or disconnect a resistor $R_7$ in parallel relationship with the resistor $R_5$. These switches $S_2$ and $S_3$ are also operated by commands from the control constant modifier 10.

In this manner, the control constants can be varied to meet an air/fuel ratio to be controlled.

Figure 18:
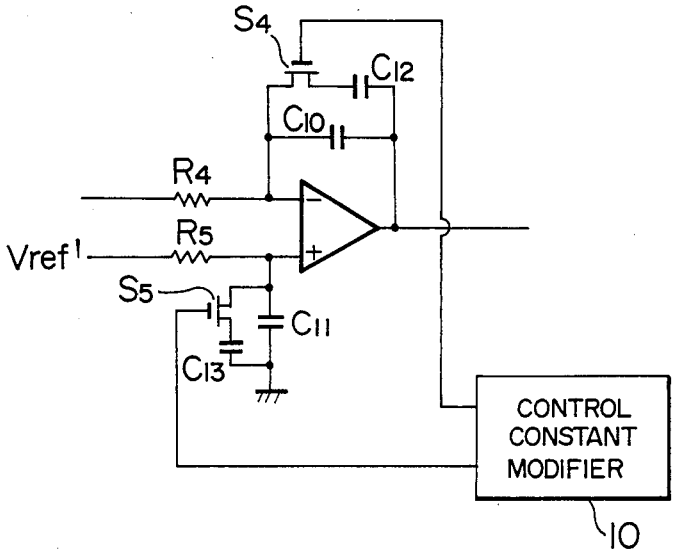
FIG. 18 is a circuit diagram showing a modification of part of the FIG. 17 circuit.

The integration constant of the integration circuit $C_4$ may also be varied using a modified circuit as shown in FIG. 18. In this modification, the integration constant can be varied by turning on or off a switch $S_4$ to connect or disconnect a capacitor $C_{12}$ in parallel relationship with the capacitor $C_{10}$ and by turning on or off a switch $S_5$ to connect or disconnect a capacitor $C_{13}$ in parallel relationship with the capacitor $C_{11}$. These switches $S_4$ and $S_5$ are again operated by commands issued from the control constant modifier 10.

Figure 19:
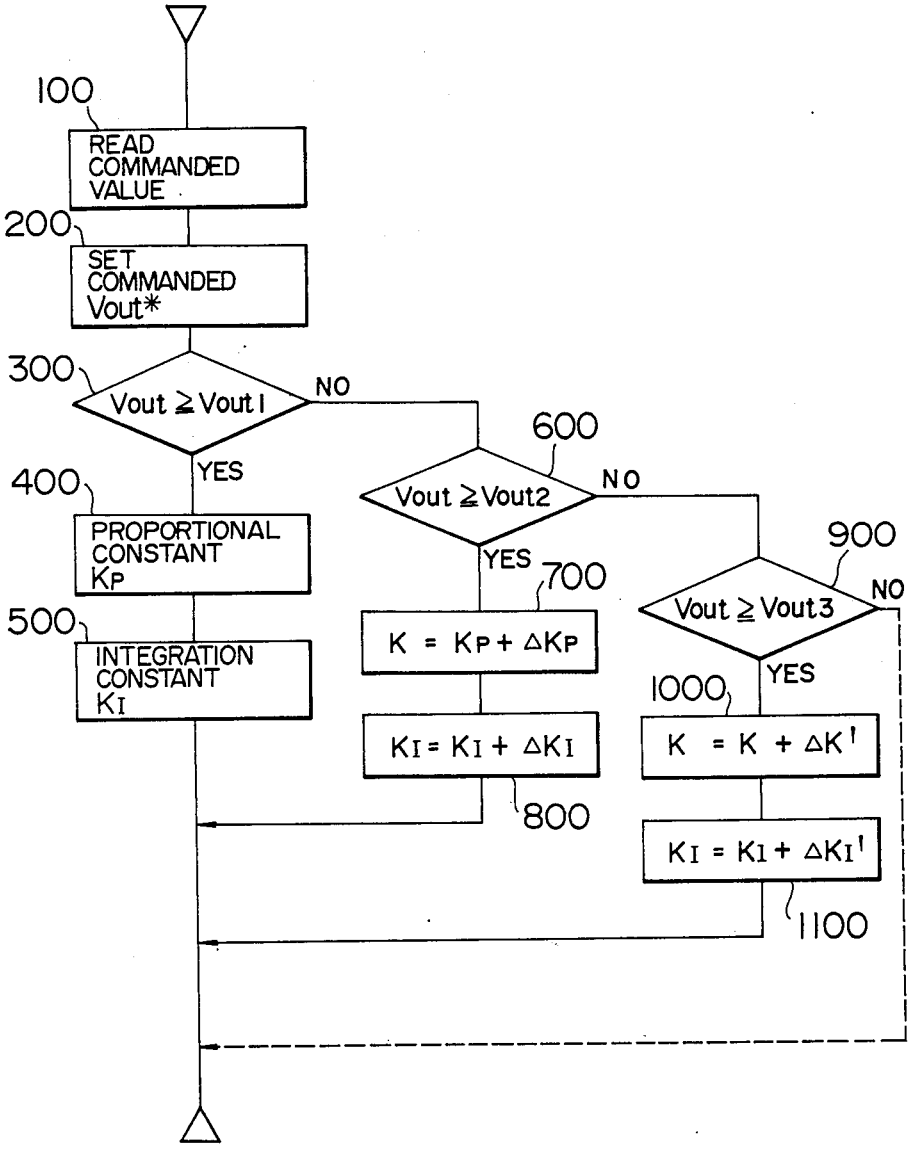
FIG. 19 is a flow chart for implementation of the FIG. 15 system according to another embodiment of the invention.

Without resort to the analog circuit as shown in FIG. 17, the proportional and integration control can be performed and the control constants therefor can be varied using a microcomputer in accordance with a flow chart as illustrated in FIG. 19.

Figure 20:
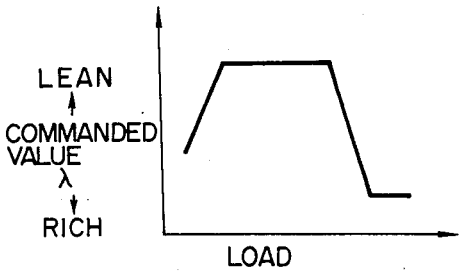
FIG. 20 illustrates map data used in the FIG. 19 embodiment.

More particularly, a commanded air/fuel ratio λ to be controlled is first read out of a map graphically illustrated in FIG. 20 as indicated at a step 100. An output value $V_{out*}$ of the air/fuel ratio sensor corresponding to the commanded λ is then set as indicated at a step 200.

Subsequently, the output value $V_{out*}$ is compared with a value $V_{out1}$ in a step 300 and when $V_{out*}$ exceeds $V_{out1}$, the proportional constant is set to $K_P$ in a step 400 and the integration constant is set to $K_I$ in a step 500. If it is decided in a step 600 that $V_{out*}$ falls within a range $V_{out1} > V_{out*} \geqq V_{out2}$, the preset proportional constant $K_P$ is incremented by $\Delta K_P$ in a step 700 and the present integration constant $K_I$ is incremented by $\Delta K_I$ in a step 800. If it is decided in a step 900 that $V_{out*}$ falls within a range $V_{out2} > V_{out*} \geqq V_{out3}$, the preset proportional constant $K_P$ is further incremented by $\Delta K_P'$ in a step 1000 and the preset integration constant $K_I$ is further incremented by $\Delta K_I'$ in a step 1100. The above operations are repeated to obtain optimum control constants which meet the air/fuel ratio to be controlled.

Figure 21:
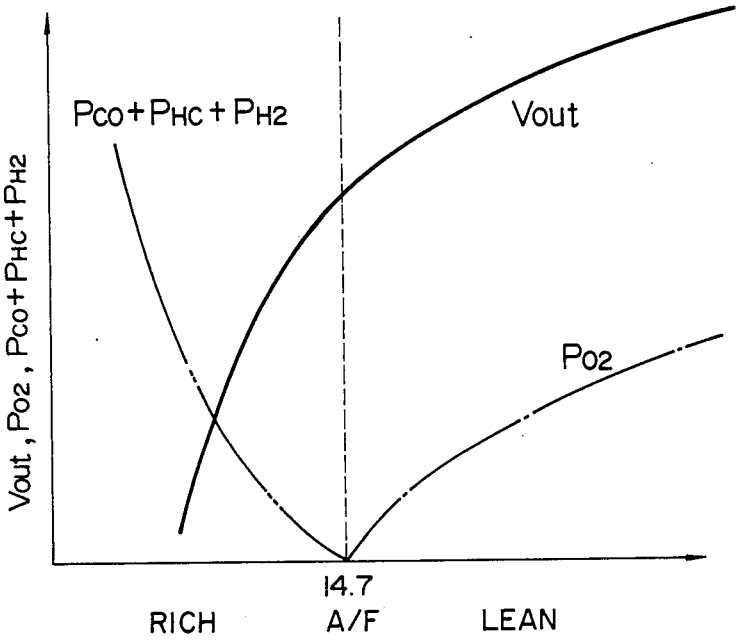
FIG. 21 is a graph showing actual output characteristics of the air/fuel ratio sensor.

There is illustrated in FIG. 21 an actual $V_{out}$ versus air/fuel ratio characteristic plotted by measuring engine exhaust gas. Since the partial pressures $P_{O2}$ and $P_{CO}+P_{HC}+P_{H2}$ change curvedly with respect to the air/fuel ratio, $V_{out}$ also changes curvedly. In other words, $V_{out}$ is subject to gains relative to the air/fuel ratio which not only change at the boundary between the rich and lean regions but also slightly vary in the lean region itself and in the rich region itself. Under the situation, it is ideal that the control constants should be varied continuously or in analog fashion with respect to changes in the air/fuel ratio to be controlled.

Figure 22:
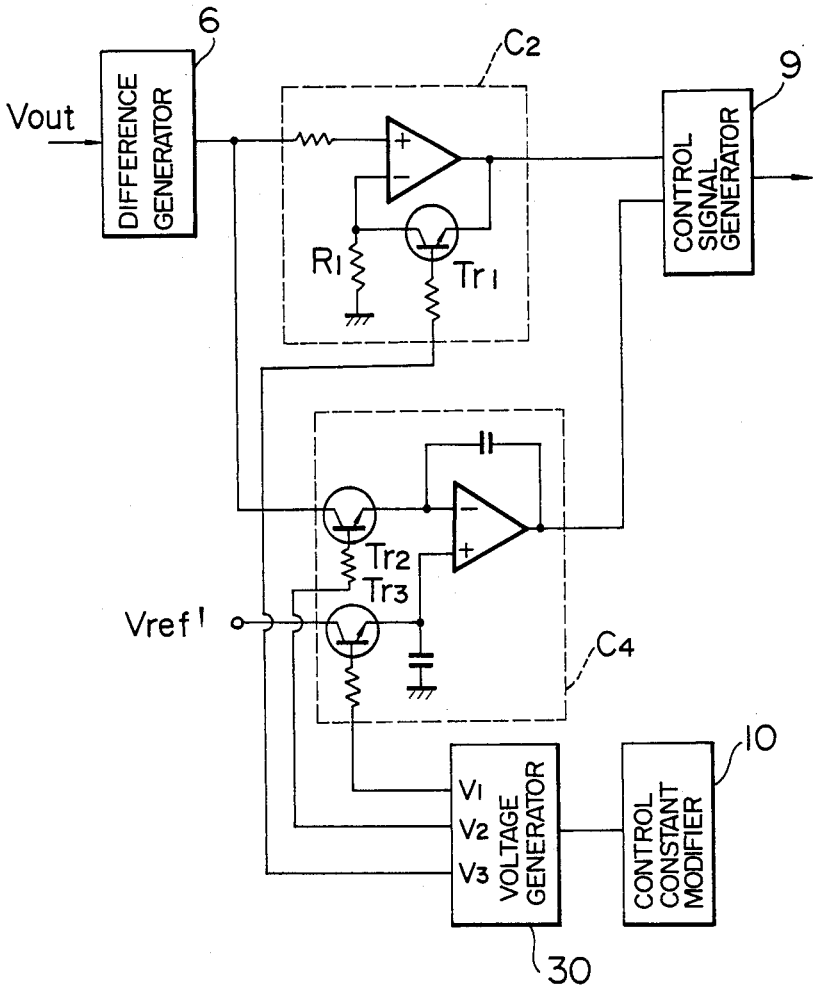
FIG. 22 is a circuit diagram for implementation of the FIG. 15 system according to further embodiment of the invention.

FIG. 22 shows a circuit arrangement to this end. For the purpose of varying the proportional constant of an amplifier circuit $C_2$, a transistor $T_{r1}$ is connected to substitute for the resistor $R_2$ included in the amplifier circuit $C_2$ of FIG. 17. The resistance of the transistor $T_{r1}$ is varied in analog fashion with the value of a voltage $V_3$ applied to its base and the proportional constant consequently varies in analog fashion. In an integration circuit $C_4$, transistors $T_{r2}$ and $T_{r3}$ are connected to substitute for the resistors $R_4$ and $R_5$ included in the integration circuit $C_4$ of FIG. 17. Similarly, the resistances of the transistors $T_{r2}$ and $T_{r3}$ are varied in analog fashion with values of voltages $V_1$ and $V_2$ applied to their bases and hence the integration constant of the integration circuit $C_4$ varies in analog fashion.

A voltage generator 30 responds to commands from the control constant modifier 10 to generate the voltages $V_1$, $V_2$ and $V_3$ and to change their levels in accordance with an air/fuel ratio set for controlling. If the voltages $V_1$, $V_2$ and $V_3$ are controlled to proportionate the $V_{out}$, exact analog operations can be performed.

In this manner, some control constants can be varied, especially, in exact analog fashion.

Figure 23:
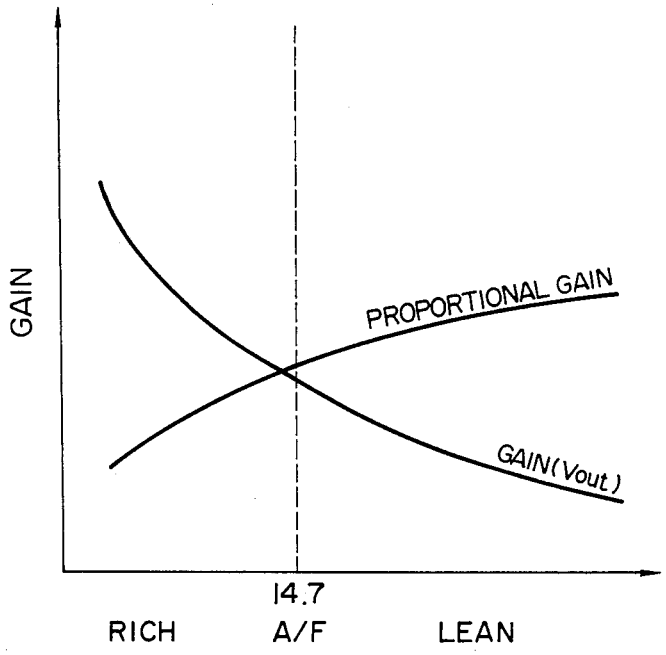
FIG. 23 is a graph showing the ideal relation between the gain of air/fuel ratio sensor and the proportional gain.

Typically, as graphically shown in FIG. 23, the $V_{out}$ is subject to gains relative to the air/fuel ratio which vary curvedly in analog fashion so as to be larger in the rich region than in the lean region and therefore, it is ideal that the proportional gain should be varied complementarily to the $V_{out}$ to trace an analog curve which is of smaller values in the rich region than in the lean region. The proportional gain can be varied to comply with the analog curve of FIG. 23 by making use of changes in resistance of the transistor used in the circuit of FIG. 22.

As has been described, according to the invention, even when the air/fuel ratio closed loop control is performed ussing an air/fuel ratio sensor having a nonlinear output characteristic relative to the air/fuel ratio, optimum control constants can always be obtained to permit stable controlling at all the values of air/fuel ratio.

What is claimed is:

1. An air/fuel ratio control apparatus for an internal combustion engine comprising:

air/fuel ratio sensor means for detecting an amount of oxygen or combustible component remaining in an exhaust gas to produce an output signal having a value which is proportional to an air/fuel ratio in said engine;

means responsive to the output signal from said air/fuel ratio sensor means for controlling by closed loop control the air/fuel ratio of a mixture of gas and air fed to said engine on the basis of predetermined air/fuel ratio control constants; and means for varying said air/fuel ratio control constants used for said closed loop control in accordance with a selected control value of air/fuel ratio.

2. An air/fuel ratio control apparatus according to claim 1 wherein said air/fuel ratio control constants include an integration constant and a proportional constant, and at least one of the two constants are varied in accordance with said selected control value of air/fuel ratio.

3. An air/fuel ratio control apparatus according to claim 2 wherein the proportional and integration constants for a first region where the air/fuel ratio is larger than the stoichiometric air/fuel ratio is made different from those for a second region where the air/fuel ratio is smaller than the stoichiometric air/fuel ratio.

4. An air/fuel ratio control apparatus according to claim 3 wherein the proportional and integration constants are varied continuously in accordance with said selected control value of air/fuel ratio.

5. An air/fuel ratio control apparatus according to claim 3 wherein the proportional and integration constants for said first region are made larger than those for said second region.

6. An air/fuel ratio control apparatus for an internal combustion engine using air/fuel ratio sensor means for detecting an amount of oxygen or combustible component remaining in an exhaust gas to produce an output signal having a value which is proportional to an air/fuel ratio in said engine and performing closed loop control of the air/fuel ratio of a mixture gas and air fed to said engine on the basis of the output signal from said air/fuel ratio sensor and in accordance with predetermined air/fuel ratio control constants, including means for varying said air/fuel ratio control constants used for the closed loop control in accordance with a selected control value of air/fuel ratio.

* * * * *